United States Patent [19]

MacMorran et al.

[11] 3,981,034

[45] Sept. 21, 1976

[54] BOX SPRING ASSEMBLY

[75] Inventors: Robert D. MacMorran; Lloyd E. Tieman; Raymond L. McQuitty, all of Carthage, Mo.

[73] Assignee: Flex-O-Lators, Inc., Carthage, Mo.

[22] Filed: Mar. 24, 1975

[21] Appl. No.: 561,072

[52] U.S. Cl. ..... 5/354; 5/223; 5/351

[51] Int. Cl.[2] ..... A47C 27/22

[58] Field of Search ..... 5/209, 223, 351, 354, 5/DIG. 2

[56] References Cited

UNITED STATES PATENTS

| | | | |
|---|---|---|---|
| 1,270,608 | 6/1918 | Evsen | 5/223 |
| 3,274,625 | 9/1966 | Metzger | 5/DIG. 2 |
| 3,733,625 | 5/1973 | Platt et al. | 5/354 |

*Primary Examiner*—Casmir A. Nunberg
*Attorney, Agent, or Firm*—John A. Hamilton

[57] ABSTRACT

A box spring assembly for a two-person bed consisting of a rectangular frame, a pair of flat, fabric-type spring sheets extending the length of the frame at opposite sides thereof so that each forms the mattress support for one person, the sheets being secured at their distal edges to the frame, and secured together at their contiguous edges by a series of laterally extending springs, the frame providing a vertical support for the springs generally at the level of the distal edges of the sheets.

9 Claims, 7 Drawing Figures

BOX SPRING ASSEMBLY

Figure 1:
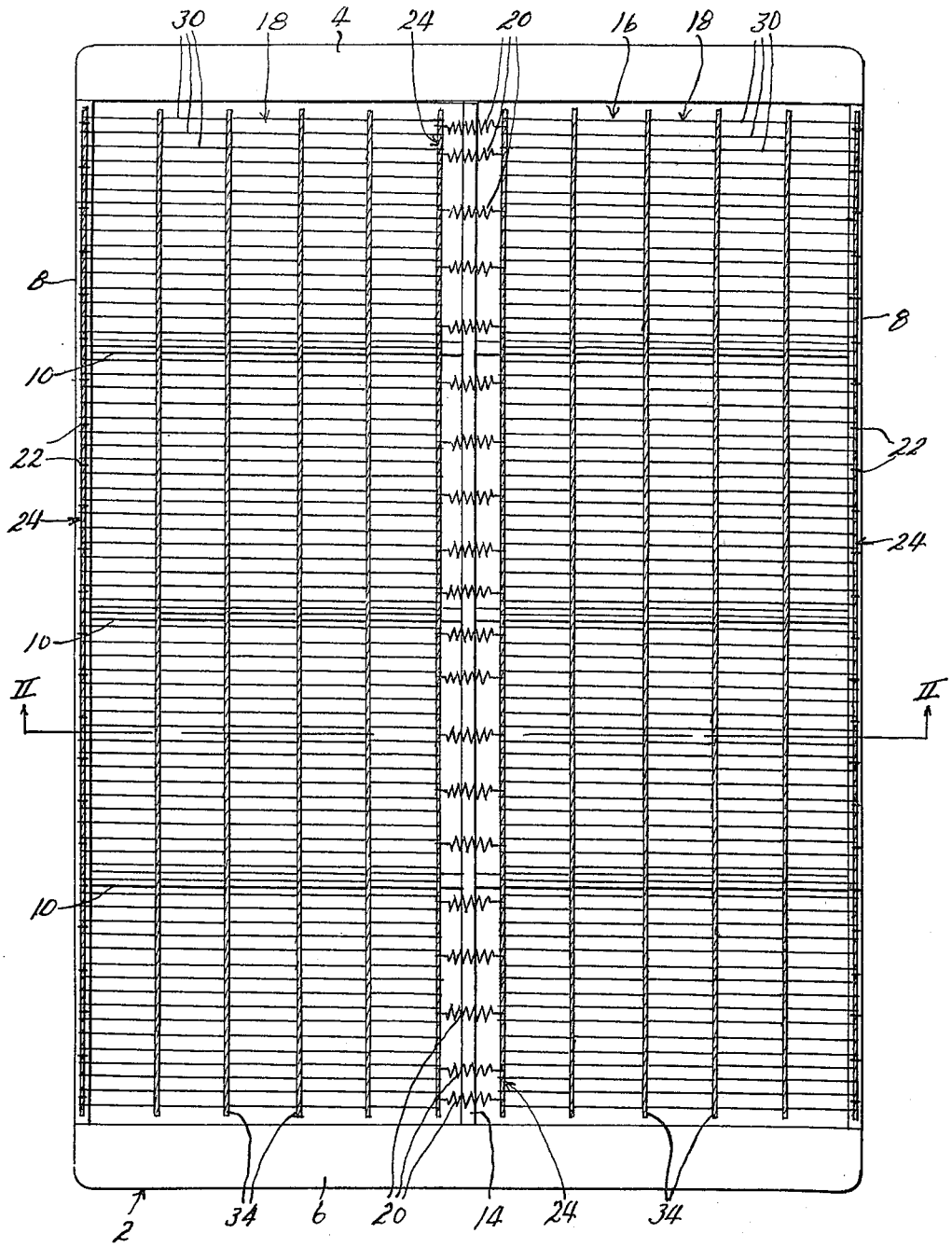

This invention relates to new and useful improvements in spring assemblies for beds, and has particular reference to box spring assemblies.

Many attempts have been made to use "flat" springs as mattress supports, or as box springs, in beds of various types. Such flat springs consist of a sheet of fabric, usually consisting of or including wire strands, or of a "linked" wire fabric, stretched across a rigid frame, and connected at one or more of its edges to said frame by laterally extending resilient springs. Said flat springs have advantages of being very thin vertically, so as to be better adapted for use in less bulky or "thin line" furniture styles, and of substantially lower cost, both in manufacture and installation, as compared, for example, to box springs consisting of a multiplicity of vertical coil springs based on a rigid support.

However, attempts to use "flat" springs as mattress supports have heretofore been less than completely successful, due principally to the pronounced tendency of such supports to sag or "hammock" between their attachments to the side rails of the frame in which they are mounted. This defect is particularly noticeable in a two-person bed when the two persons are not of the same weights. The heavier person causes the bed to sag more deeply in his own area causing a tendency of the lighter person to roll or slide downwardly toward the heavier person. This effect is most pronounced when the overlying mattress is of a foam type, so that its upper surface tends to conform more closely to the contour of the supporting box springs, but is nevertheless quite apparent, and causes discomfort, even when the overlying mattress is of the inner-spring type. Inner-spring mattresses consist of a multiplicity of vertical coil springs enclosed in a casing, so that to some extent depression of its upper surface is confined to the actual load area, but actually there are virtually always some sort of transverse ties between the springs, even if only the mattress casing, so that greater depression of one area of the mattress by a heavier person still tends to produce an upward slope of the mattress surface toward the lighter person, which in turn is emphasized and increased by any transverse sagging of the supporting box springs.

Accordingly, the principal object of the present invention is the provision of a box spring assembly which, while utilizing flat, fabric type support sheets resiliently supported only at certain edges thereof, whereby to take advantage of the economy and ease of installation of such sheets, nevertheless will not permit any sagging due to its resilient support in the area thereof occupied by one person to cause sagging of the portion thereof occupied by the second person. In this manner, independent support is provided for each person, there will be no "valley" along the centerline of the bed, and differences of weight of the persons, or movements by either of them cannot affect the comfort of the other. Generally, this object is accomplished by the provision of a box spring assembly including a sturdy frame having parallel side rails and an intermediate center rail, and a flat composite sheet of wire fabric laid over said frame, connected to said side rails, and supported on said center rail, said composite wire fabric sheet including means, respectively at both sides of said center rail, permitting elastic stretching of said sheet in a direction transverse to the frame.

Another object is the provision of a box spring assembly of the character described in which said composite sheet comprises two strips of wire fabric which are inelastic in their own planes, and each of which substantially covers one transverse half of said frame, their distal edges being fixed to said frame side rails, and their contiguous edges being spaced apart and connected by springs or other resilient members yieldable transversely of said frame, said springs being supported on said center rail. In this manner, a single set of springs provides substantially independent elastic support for both sides of the assembly.

A further object is the provision of a box spring assembly of the character described including means for adjusting the "firmness" or yieldability of the two sides of the assembly independently of each other. This may be done by attaching variable points of said springs to said center rail, thereby disposing different proportions of the lengths thereof at respectively opposite sides of said center rail to give different degrees of resilient support to the non-resilient sheets at respectively opposite sides thereof.

Other objects are simplicity and economy of construction, and efficiency and dependability of operation.

Figure 2:
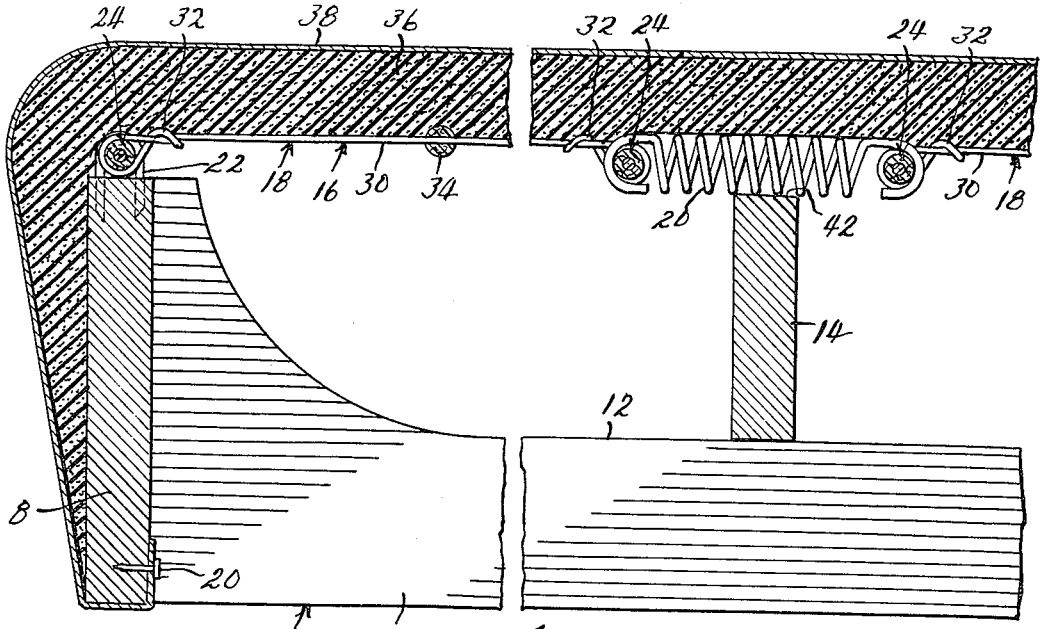

With these objects in view, as well as other objects which will appear in the course of the specification, reference will be had to the accompanying drawing, wherein:

FIG. 1 is a top plan view of a box spring assembly embodying the present invention, with the padding and cover sheet omitted, FIG. 2 is an enlarged, fragmentary sectional view taken on line II—II of FIG. 1, partially broken away and foreshortened, and including the padding and cover sheet.

Figure 3:
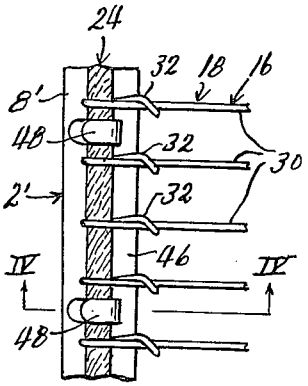
Figure 5:
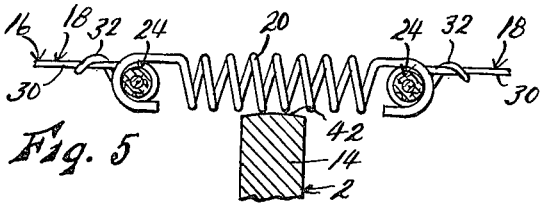
Figure 6:
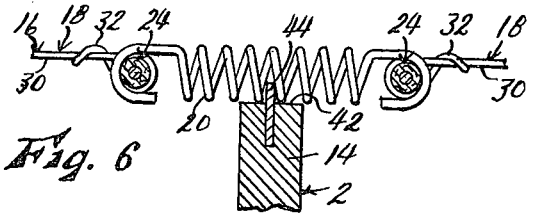
Figure 4:
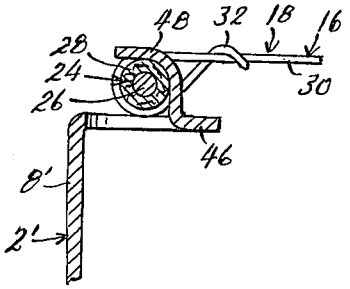
Figure 7:
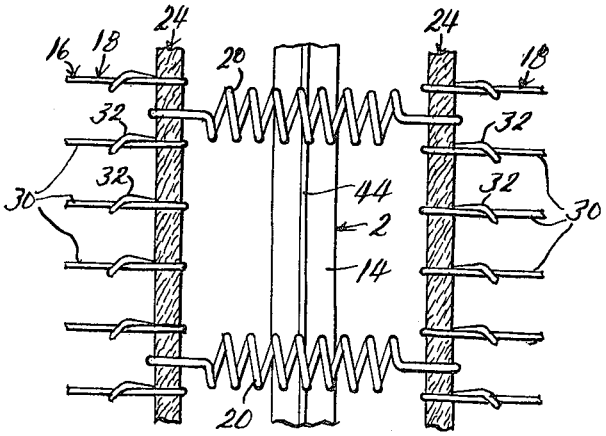

FIG. 3 is an enlarged, fragmentary view similar to FIG. 1, but modified to show the attachment of the wire fabric sheets in a steel or other metal frame, FIG. 4 is an enlarged sectional view taken on line IV—IV of FIG. 3, FIG. 5 is a fragmentary view similar to FIG. 2, showing a slight modification of structure, FIG. 6 is a view similar to FIG. 5, showing another modification of structure, and FIG. 7 is a fragmentary top plan view of the structural modification shown in FIG. 6.

Like reference numerals apply to similar parts throughout the several views, and the numeral 2 applies generally to the rigid frame of the box spring assembly forming the subject matter of the present invention. Said frame includes a head rail 4, foot rail 6, and side rails 8, all formed of wood (except in FIG. 4), and rigidly connected together to form a unitary structure of rectangular form. Spreader bars 10 parallel to the head and foot rails extend laterally across said frame at regular intervals between the head and foot rails, and are affixed at their ends to side rails 8. The upper edge portions of said spreader bars are cut away at 12, as best shown in FIG. 2, to reduce the vertical height thereof to permit the resiliently supported wire fabric sheets supported over said frame, as will be described, to be deflected downwardly by loads imposed thereon. Extending along the longitudinal midline of the frame, parallel to side rails 8, is a center rail 14. Said center rail is affixed at its ends to head and foot rails 4 and 6, and is supported by and affixed along its lower edge to spreader bars 10. Its upper edge is parallel to and generally at the same elevation as the upper edges of side rails 8.

Frame 2 has laid thereover a composite wire fabric sheet indicated generally by the numeral 16, and comprising, as shown, a pair of wire fabric strips 18 each extending longitudinally of the frame and covering generally one lateral half of said frame, and a series of laterally extending helical springs 20 extending between and connecting the spaced apart contiguous edges of fabric strips 18, at spaced apart points along the lengths of said fabric strips. The contiguous edges of said strips are disposed respectively at opposite sides of center rail 14, while springs 20 extend across the upper edge of said center rail, and are supported thereon. The distal edges of fabric strips 18 are disposed respectively above the top edges of side rails 8, and are secured fixedly thereto, along their lengths, by means of staples 22 (see FIG. 2). The end edges of fabric strips 18 are not connected to the head and foot rails of the frame, but are preferably spaced slightly apart therefrom, as shown.

As shown, each wire fabric strip 18 includes a pair of spaced apart, parallel edge strands 24 which extend longitudinally of frame 2, and each of which comprises a spring wire core 26 enclosed in a sheath 28 of twisted paper or other soft, indentable material. The side strands are connected by a continous series of closely spaced apart spring cross wires 30, each of said cross wires being twisted and "knotted" at its ends around side strands 24, as indicated at 32. To preserve the spacing of the cross wires between side strands 24, there are provided a plurality, as many as may be found necessary, of intermediate strands 34 extending parallel to and being spaced regularly between said side strands. As shown in FIG. 2, intermediate strands 34 may consist entirely of twisted paper, and are pierced by cross wires 30. The entire assembly of each wire fabric strip 18 may be coated, if desired, by dipping in a suitable plastic compound, this coating not being shown, in order better to preserve the proper relationships of its various wires and strands, and to better protect it against corrosion.

Staples 22 bridge the associated side strands 24, and are driven into the top edges of side frame rails 8 to secure the distal edges of fabric strips 18, while helical springs 20 are provided at their ends with hook formations for engaging about the side strands 24 at the contiguous edges of strips 18. The composite wire fabric sheet may be installed with any desired degree of tension in springs 20. In this connection, the inclusion of wire cores 26 in side strands 24, these cores being heavier than cross wires 30, permits the use of fewer staples 22, and a wider spacing of springs 20, than would otherwise be necessary. The structure of the box springs is completed, in most cases, by a layer of foam or other padding material 36 laid over the entire area of frame 2, and secured by a cover sheet 38 of cloth fabric or the like laid thereover and secured at its edges to frame 2 as by nails, as indicated at 40 in FIG. 2. While the padding is not essential to the present invention, it will be seen that if said padding is used, the close spacing of cross wires 30 of the wire fabric strips 18 provides fully adequate support for said padding, preventing it from working downwardly through the spaces between said wires. A cross wire spacing of about one inch has been found adequately small for this purpose. The usual mattress, of foam, inner spring or other construction, is not shown, but of course is simply laid over the box spring assembly as just described, in the usual manner.

In operation, it will be seen that each wire fabric strip 18 forms the mattress support for one person in a two-person bed, and that each strip 18, being affixed at one edge to a side rail 8 and at its opposite edge to springs 20, which in turn are supported by center rail 14, can yield or "hammock" independently of the other. That is, the downward yielding of one strip is not transmitted to the other, and therefore the weight of a heavier person at one side of the bed cannot cause a general transverse sloping of the bed surface which would result in a lighter person at the opposite side of the bed sliding or rolling toward the heavier person. This of course is the primary object of the present invention. Some transverse hammocking of each strip 18, though independent of any hammocking of the other strip, is necessary in order to provide the resilient "depth" of support necessary for comfort, but if this hammocking of each strip 18 is too pronounced, it can cause discomfort even to the individual lying over that strip, giving him a sensation of sleeping in a "trough". To prevent this excessive hammocking of each strip 18, the use of transverse cross wires 30 of spring steel is a feature of the invention. These wires, due to their multiplicity and to their spring character, tend to reduce hammocking thereof, in that it forces a greater proportion of the vertical deflection thereof to be accomplished by extension of springs 20 rather than by bowing of the wires 30 themselves. In other words, the strips 18 are caused to function to a greater degree as "platforms", rather than as pliable hammocks.

The use of springs 20 at the adjoining contiguous edges of strips 18, and the support of said springs directly on center rail 14, rather than using a single sheet of wire fabric covering the entire area of frame 2 and supporting it resiliently from side rails 8, as would be possible in the broader aspects of the invention, has the advantage that a single set of springs thus provides independent spring support for both sides of the bed, which is a valuable economy in production costs, both as to the reduced number of springs required, and in the time required for installation. The presence of center rail 14 of course tends to produce a central "ridge" in the bed surface, but this in most cases is not considered to be objectionable, nor will it cause appreciable discomfort to persons lying across the center rail, both because of thickness of the mattress overlying the box springs, which is several times thicker than the padding 36 shown, and because of the modern tendency to firmer and firmer mattress supports, often to the point that they are called "mattress supports" rather than "box springs", and amount virtually to rigid platforms rather than springs. Usually, however, at least some degree of resilient yieldability is desirable for maximum comfort. The firmness or degree of yieldability of the wire fabric strips 18 may be adjusted very easily simply by changing the weight of the springs 20 utilized, or even accomplished with standard springs by changing the number and spacing of springs utilized. Also, any desired regions of the sheets, such as those supporting the hips and shoulders of the occupants, may be made stiffer or firmer simply by concentrating a greater number of springs 20 in those zones.

If the top edge 42 of center rail 14 is square-cornered, as shown in FIG. 2, the convolutions of springs 20 may "jump" or "snap" over the corners thereof if one side of the bed is loaded while the other is not, or if the two sides are loaded unequally, and this spring movement may cause a feeling of "lurching" and discomfort, and also be accompanied by undesirable noises. To prevent this, top edge 42 of center rail 14 may be formed with an upwardly convex transverse curvature as shown in FIG. 5, which permits the springs to slide freely thereover whenever necessary.

Of course, free slippage of springs 20 across center rail 14 results in the fact that both wire fabric strips 18 will be supported with substantially equal spring tensions, or, in other words, that both sides of the bed will have equal firmness. This may not always be desirable, as when one occupant requires or desires a firmer support than the other person. This problem may be solved by providing the center rail with an upstanding "blade", or thin upward projection 44, as shown in FIGS. 6 and 7. Said projection is anchored firmly in rail 14, midway of its thickness, and extends upwardly therefrom sufficiently to project between a pair of adjoining convolutions of each spring 20, as shown. As long as projection 44 extends continuously the full length of rail 14, it will not interfere with any desired placement of springs 20 along the length of said rail. Member 44 thus not only positively prevents any possible slippage of springs 20 transversely across rail 14, but also, by engaging projection 44 between selected convolutions of the springs, permits unequal proportions of the spring lengths to be disposed at respectively opposite sides of the projection. In this manner, one wire fabric strip 18 may be supported by a relatively few convolutions of the springs, and thus be supported firmly, while the other strip 18, supported by a relatively large number of spring convolutions, will be relatively softly and yieldably supported, according to the needs or desires of the two persons occupying the bed. This adjustment may be made simply be inverting the assembly, pushing springs 20 out of engagement with projection 44, and re-engaging any selected convolutions thereof over said projection, without no necessity of disassembly.

FIGS. 3 and 4 show a slight modification of structure in which frame 2' is formed of steel or other metal, rather than wood. Each side rail 8' thereof is of angular form, having a horizontal top leg 46 from which outwardly facing hook members 48 are struck out at intervals along the length of said rail. The associated side strand 24 of the adjacent fabric strip 18 is simply engaged in said hooks, and retained therein by the tension of springs 20. The paper sheathing 28 of said side strands prevents wire noises and provides good purchase for the knotting of cross wires 30 thereabout.

While we have shown and described certain specific embodiments of our invention, it will be readily apparent that many minor changes of structure and operation could be made without departing from the spirit of the invention.

What we claim as new and desire to protect by Letters Patent is:

1. A box spring assembly for a two-person bed comprising:

a. a rigid, open, generally rectangular frame including generally parallel side rails and a rigid center rail generally parallel with and midway between said side rails, b. a composite sheet of flat, flexible material overlying said frame, and c. means securing said sheet to said side rails, said sheet being supported intermediate said side rails on said center rail, said sheet including resilient means at both sides of said center rail and operable to permit elastic extension of said sheet in its own plane in a direction transversely of said frame, whereby downward deflection of said sheet at one side of said center rail will not cause downward deflection of said sheet at the opposite side of said center rail.

2. A box spring assembly as recited in claim 1 wherein said composite sheet comprises:

a. two strips of material each overlying substantially the portion of said frame between said center rail and one of said side rails, the distal edges of said strips being secured to said side rails, and their contiguous edges being spaced apart at opposite sides of said center rail, and b. a plurality of elongated, resiliently extensible connector members interconnecting the contiguous edges of said strips, extending transversely across and being supported by said center rail.

3. A box spring assembly as recited in claim 2 wherein each of the strips of said composite sheet comprises a sheet of fabric inelastic in its own plane.

4. A box spring assembly as recited in claim 2 wherein each of the strips of said composite sheet comprises a sheet of wire fabric inelastic in its own plane, but possessing a degree of resilient resistance to flexure transversely of its plane, whereby to impart a degree of stiffness thereto.

5. A box spring assembly as recited in claim 4 wherein each of said sheets of wire fabric includes a continuous series of resilient spring cross wires extending transversely of said frame, whereby to resist hammocking of said sheet between said center rail and the associated side rail.

6. A box spring assembly as recited in claim 2 wherein said connector members each comprises a helical spring extending transversely of said frame, supported intermediate its ends on said center rail, and connected at its respective ends to the adjacent edges of the two strips of said composite sheet.

7. A box spring assembly as recited in claim 6 wherein the top edge of said center rail is convexly rounded transversely of said frame, whereby said springs may slide freely thereover in a direction transverse to said frame.

8. A box spring assembly as recited in claim 2 with the addition of means operable to secure selected points of the length of each of said resiliently extensible connectors to said center rail against movement transversely of said frame, whereby variable proportions of said connector may be disposed at respectively opposite sides of said center rail.

9. A box spring assembly as recited in claim 2 wherein each of said connector members comprises an elongated helical spring, and with the addition of a thin upward projection carried by said center rail longitudinally thereof and projecting upwardly from said center rail to engage selectively between any selected pair of consecutive convolutions of said springs.

* * * * *